US011380264B2

(12) United States Patent
Ding et al.

(10) Patent No.: US 11,380,264 B2
(45) Date of Patent: Jul. 5, 2022

(54) PIXEL CIRCUIT, METHOD FOR DRIVING THE PIXEL CIRCUIT AND DISPLAY DEVICE

(71) Applicant: BOE TECHNOLOGY GROUP CO., LTD., Beijing (CN)

(72) Inventors: Xiaoliang Ding, Beijing (CN); Xue Dong, Beijing (CN); Haisheng Wang, Beijing (CN); Yingming Liu, Beijing (CN); Changfeng Li, Beijing (CN); Wei Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 641 days.

(21) Appl. No.: 16/338,762

(22) PCT Filed: Oct. 17, 2018

(86) PCT No.: PCT/CN2018/110639
§ 371 (c)(1),
(2) Date: Apr. 2, 2019

(87) PCT Pub. No.: WO2019/091267
PCT Pub. Date: May 16, 2019

(65) Prior Publication Data

US 2021/0350750 A1 Nov. 11, 2021

(30) Foreign Application Priority Data

Nov. 7, 2017 (CN) ..... 201711083776.4

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2310/0202* (2013.01);
(Continued)

(58) Field of Classification Search
CPC ... G06F 3/042; G06F 3/04184; G09G 3/3208; G09G 3/3225; G09G 3/3233;
(Continued)

(56) References Cited

U.S. PATENT DOCUMENTS

2007/0205999 A1* 9/2007 Akimoto ..... G06F 3/0412 345/207
2010/0020051 A1* 1/2010 Kim ..... G09G 3/3233 345/207

(Continued)

FOREIGN PATENT DOCUMENTS

CN 101034236 A 9/2007
CN 100580534 C 1/2010
CN 107610647 A 1/2018

OTHER PUBLICATIONS

International Search Report and Written Opinion for Application No. PCT/CN2018/110639, dated Jan. 16, 2019, 10 Pages.

(Continued)

*Primary Examiner* — Michael J Eurice
(74) *Attorney, Agent, or Firm* — Brooks Kushman P.C.

(57) ABSTRACT

The present disclosure provides a pixel circuit, a method for driving the pixel circuit and a display device. A driving module of the pixel unit circuit includes a pixel compensation unit configured to transmit a read-control signal to the corresponding row of read-control line and transmit a gate drive-control signal to the gate drive circuit. The gate drive circuit is configured to, based on the gate drive-control signal, generate a plurality of gate drive signals, thereby controlling the rows of gate lines to be turned off in a reading period. One gate drive signal is corresponding to one row of gate line.

11 Claims, 4 Drawing Sheets

(52) U.S. Cl.
CPC . *G09G 2310/0243* (2013.01); *G09G 2310/08* (2013.01); *G09G 2360/147* (2013.01)

(58) Field of Classification Search
CPC ..... G09G 3/3258; G09G 3/3266; G09G 2300/0819; G09G 2310/0202; G09G 2310/0243; G09G 2310/08; G09G 2320/0295; G09G 2320/045; G09G 2320/0214; G09G 2320/0233; G09G 2360/14; G09G 2360/145; G09G 2360/147; G09G 2360/148
See application file for complete search history.

(56) References Cited

U.S. PATENT DOCUMENTS

| | | | | |
|---|---|---|---|---|
| 2013/0027438 | A1* | 1/2013 | Hu | G09G 3/3413 345/690 |
| 2017/0039952 | A1 | 2/2017 | Kim | |
| 2020/0058252 | A1* | 2/2020 | Kim | G09G 3/3258 |
| 2021/0280129 | A1* | 9/2021 | Chaji | G09G 3/3225 |

OTHER PUBLICATIONS

Second Office Action for Chinese Application No. 201711083776.4, dated Nov. 11, 2019, 6 Pages.

* cited by examiner

PIXEL CIRCUIT, METHOD FOR DRIVING THE PIXEL CIRCUIT AND DISPLAY DEVICE

CROSS-REFERENCE TO RELATED APPLICATION APPLICATIONS

This application is the U.S. national phase of PCT Application No. PCT/CN2018/110639 filed on Oct. 17, 2018, which claims priority to Chinese Patent Application No. 201711083776.4 filed on Nov. 7, 2017, which are incorporated herein by reference in their entireties.

TECHNICAL FIELD

The present disclosure relates to the field of display technologies, and in particular to a pixel circuit, a method for driving the circuit and a display device.

BACKGROUND

One pixel compensation unit for a display device based on organic light emitting diodes (OLEDs) generally includes: a light sensing module used for converting a light signal emitted by a pixel unit into a corresponding electrical signal; a read-control module used for controlling transmission of the electrical signal to a reading line at a corresponding column during a reading period under control of a read control signal on a read-control line at a corresponding row; and a data voltage compensation module used for compensating a data voltage on a data line at a corresponding column according to the electrical signal. However, the above pixel compensation unit could not avoid influence of timing of gate and data lines on the light sensing module, and could not dynamically adjust integration time, which lead to an inaccurate compensation result.

SUMMARY

One embodiment of the present disclosure provides a pixel circuit including: a plurality of rows of gate lines; a plurality of rows of read-control lines; pixel unit circuits arranged in rows and columns; and a driving module. The pixel unit circuit includes a pixel compensation unit; the pixel compensation unit is coupled with the corresponding row of read-control line; the driving module includes a gate drive circuit coupled with the rows of gate lines, and a signal generation unit. The signal generation unit is coupled with the gate drive circuit and the pixel compensation unit, and is configured to generate a read-control signal and a gate drive-control signal, transmit the read-control signal to the corresponding row of read-control line and transmit the gate drive-control signal to the gate drive circuit. The gate drive circuit is configured to, based on the gate drive-control signal, generate a plurality of gate drive signals, thereby controlling the rows of gate lines to be turned off in a reading period.

In implementation, the pixel compensation unit includes a light sensing module configured to convert a light signal emitted by the pixel unit into a corresponding electrical signal; and the signal generation unit is configured to generate the read-control signal based on the electrical signal.

In implementation, the pixel compensation unit includes a read-control module; the pixel circuit further includes a plurality of columns of read lines; the read-control module is coupled with the corresponding column of read line; the electrical signal is a charge signal. The signal generation unit is specifically configured to determine a corresponding integration time based on quantity of electric charges indicated by the electrical signal and generate a corresponding read-control signal based on the integration time. The integration time is a time interval between a first moment and a second moment, the first moment is a moment at which the read-control module is controlled by the read control signal to begin transmitting the electrical signal to the corresponding column of read line, and the second moment is a moment at which the read-control module is controlled by the read control signal for the next time to begin transmitting the electrical signal to the corresponding column of read line after the reading period ends.

One embodiment of the present disclosure provides a method for driving the above pixel circuit, including: generating, by the signal generation unit, a read-control signal and a gate drive-control signal, and transmitting the read-control signal to the corresponding row of read-control line and transmitting the gate drive-control signal to the gate drive circuit; and generating, by the gate drive circuit based on the gate drive-control signal, a plurality of gate drive signals, thereby controlling the rows of gate lines to be turned off in a reading period.

In implementation, generating, by the signal generation unit, a read-control signal, specifically includes: generating, by the signal generation unit based on an electrical signal, the read-control signal; wherein the electrical signal is obtained by converting, by a light sensing module of the pixel compensation unit, a light signal emitted from the pixel unit.

In implementation, the pixel compensation unit includes a read-control module; the pixel circuit further includes a plurality of columns of read lines; the read-control module is coupled with the corresponding column of read line; the electrical signal is a charge signal. Generating, by the signal generation unit based on an electrical signal, the read-control signal, includes: determining, by the signal generation unit, a corresponding integration time based on quantity of electric charges indicated by the electrical signal and generating a corresponding read-control signal based on the integration time. The integration time is a time interval between a first moment and a second moment, the first moment is a moment at which the read-control module is controlled by the read control signal to begin transmitting the electrical signal to the corresponding column of read line, and the second moment is a moment at which the read-control module is controlled by the read control signal for the next time to begin transmitting the electrical signal to the corresponding column of read line after the reading period ends.

In implementation, the charge signal includes a first charge signal and a second charge signal, a first quantity of electric charges indicated by the first charge signal is greater than a second quantity of electric charges indicated by the second charge signal; a first integration time determined by the signal generation unit based on the first quantity of electric charges, is less than a second integration time determined by the signal generation unit based on the second quantity of electric charges.

In implementation, the pixel compensation unit includes a light sensing module and a read-control module; the pixel circuit further includes a plurality of columns of read lines; the read-control module is coupled with the corresponding column of read line. In one driving cycle, an n-th reading period is set between a period in which an n-th row of gate line is turned on and a period in which an (n+1)-th row of gate line is turned on; an N-th reading period is set in adjacent two driving cycles, where N is a quantity of rows of gate lines included in the pixel circuit, and N is a positive integer. Transmitting, by the signal generation unit, the read-control signal to the corresponding row of read-control line includes: outputting, by the signal generation unit, a corresponding read-control signal to an n-th row of read-control line, thereby enabling the read-control modules of all the pixel compensation units in the n-th row of the pixel circuit to be turned on in the n-th reading period and then turning on connection between the light sensing modules of the pixel compensation units in the n-th row and the corresponding columns of read lines; and outputting, by the signal generation unit, a corresponding read-control signal to an N-th row of read-control line, thereby enabling the read-control modules of all the pixel compensation units in the N-th row of the pixel circuit to be turned on in the N-th reading period and then turning on connection between the light sensing modules of the pixel compensation units in the N-th row and the corresponding columns of read lines. Generating, by the gate drive circuit based on the gate drive-control signal, a plurality of gate drive signals, thereby controlling the rows of gate lines to be turned off in a reading period, includes: generating, by the gate drive circuit based on the gate drive-control signal, a plurality of gate drive signals, thereby controlling all the gate lines in the pixel circuit to be turned off in the n-th reading period and the N-th reading period, where n is a positive integer and (n+1) is less than or equal to N.

In implementation, the pixel compensation unit includes a light sensing module and a read-control module; the pixel circuit further includes a plurality of columns of read lines; the read-control module is coupled with the corresponding column of read line. In one driving cycle, an n-th reading period is set between a period in which an n-th row of gate line is turned on and a period in which an (n+1)-th row of gate line is turned on; an (n+1)-reading period is set between the period in which the (n+1)-th row of gate line is turned on and a period in which an (n+2)-th row of gate line is turned on; an N-reading period is set in adjacent two driving cycles, where N is a quantity of rows of gate lines included in the pixel circuit, and N is a positive integer. Transmitting, by the signal generation unit, the read-control signal to the corresponding row of read-control line includes: outputting, by the signal generation unit, a corresponding read-control signal to an n-th row of read-control line, thereby enabling the read-control modules of all the pixel compensation units in the n-th row of the pixel circuit to be turned on in the n-th reading period and the (n+1)-th reading period, and then turning on connection between the light sensing modules of the pixel compensation units in the n-th row and the corresponding columns of read lines; and outputting, by the signal generation unit, a corresponding read-control signal to an N-th row of read-control line, thereby enabling the read-control modules of all the pixel compensation units in the N-th row of the pixel circuit to be turned on in the N-th reading period and the first reading period and then turning on connection between the light sensing modules of the pixel compensation units in the N-th row and the corresponding columns of read lines. Generating, by the gate drive circuit based on the gate drive-control signal, a plurality of gate drive signals, thereby controlling the rows of gate lines to be turned off in a reading period, includes: generating, by the gate drive circuit based on the gate drive-control signal, a plurality of gate drive signals, thereby controlling all the gate lines in the pixel circuit to be turned off in the n-th reading period and the N-th reading period, where n is a positive integer and (n+1) is less than or equal to N.

In implementation, the pixel compensation unit includes a light sensing module and a read-control module; the pixel circuit further includes a plurality of columns of read lines; the read-control module is coupled with the corresponding column of read line; a blank stage is set between two adjacent display stages; the blank stage includes M reading periods arranged sequentially, where M is a quantity of rows of read-control lines included in the pixel circuit, and M is a positive integer. Generating, by the gate drive circuit based on the gate drive-control signal, a plurality of gate drive signals, thereby controlling the rows of gate lines to be turned off in a reading period, includes: generating, by the gate drive circuit based on the gate drive-control signal, a plurality of gate drive signals, thereby controlling all the gate lines in the pixel circuit to be turned off in the blank stage. Transmitting, by the signal generation unit, the read-control signal to the corresponding row of read-control line includes: outputting, by the signal generation unit, a corresponding read-control signal to an a-th row of read-control line, thereby enabling the read-control modules of all the pixel compensation units in the a-th row of the pixel circuit to be turned on in the a-th reading period of the blank stage and then turning on connection between the light sensing modules of the pixel compensation units in the a-th row and the corresponding columns of read lines; where a is a positive integer which is less than or equal to M.

In implementation, the pixel compensation unit includes a light sensing module and a read-control module; the pixel circuit further includes a plurality of columns of read lines; the read-control module is coupled with the corresponding column of read line; a blank cycle is set between two adjacent display cycles. The blank cycle includes M reading periods arranged sequentially, M is a quantity of rows of read-control lines included in the pixel circuit, and M is a positive integer. Generating, by the gate drive circuit based on the gate drive-control signal, a plurality of gate drive signals, thereby controlling the rows of gate lines to be turned off in a reading period, includes: generating, by the gate drive circuit based on the gate drive-control signal, a plurality of gate drive signals, thereby controlling all the gate lines in the pixel circuit to be turned off in the blank cycle. Transmitting, by the signal generation unit, the read-control signal to the corresponding row of read-control line includes: outputting, by the signal generation unit, a corresponding read-control signal to a b-th row of read-control line, thereby enabling the read-control modules of all the pixel compensation units in the b-th row of the pixel circuit to be turned on in the b-th reading period of the blank cycle and then turning on connection between the light sensing modules of the pixel compensation units in the b-th row and the corresponding columns of read lines; where b is a positive integer which is less than or equal to M.

One embodiment of the present disclosure provides a display device including the pixel circuit.

DETAILED DESCRIPTION

The technical solutions of embodiments of the present disclosure will be described hereinafter in a clear and complete manner in conjunction with the drawings of the embodiments. Obviously, the following embodiments are merely a part of, rather than all of, the embodiments of the present disclosure, and based on these embodiments, a person skilled in the art may obtain the other embodiments, which also fall within the scope of the present disclosure.

Figure 1A:
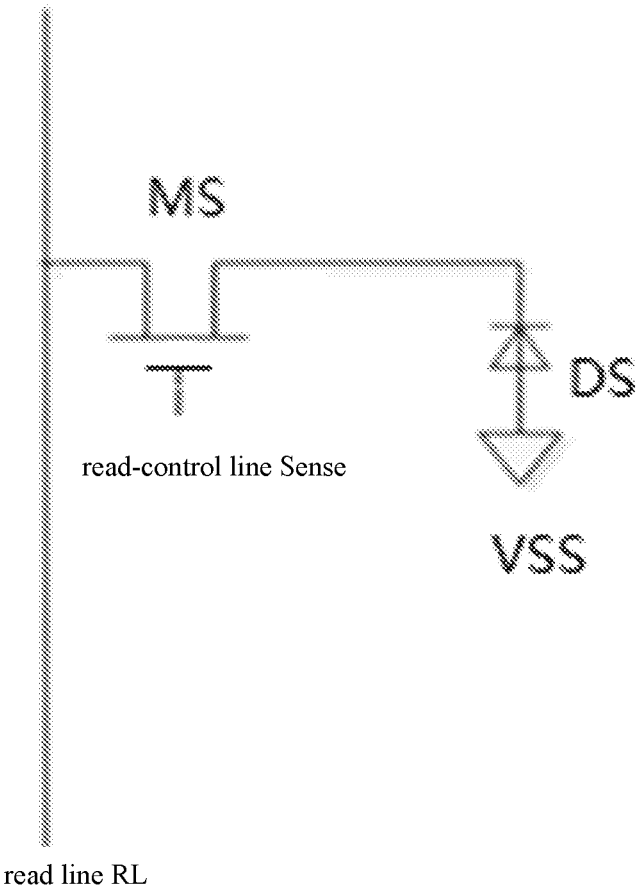
FIG. 1A is a circuit diagram of a pixel compensation unit.

As shown in FIG. 1A, one pixel compensation unit includes a read control transistor MS, a photosensitive diode DS. A gate electrode of the read control transistor MS is coupled with a corresponding read-control line Sense. A source electrode of the read control transistor MS is coupled with a read line RL. An anode of the photosensitive diode is coupled with a low-level input terminal VSS. A cathode of the photosensitive diode is coupled with a drain electrode of the read control transistor MS. However, the above pixel compensation unit could not avoid influence of timing of gate and data lines on a light sensing module, and could not dynamically adjust integration time, which lead to an inaccurate compensation result.

Transistors adopted in all embodiments of the present disclosure may be thin film transistors, field effect transistors or other devices with the same characteristics. In some embodiments of the present disclosure, in order to distinguish two electrodes of the transistor except for the gate electrode, one of the two electrodes may be referred as a first electrode and the other of the two electrodes may be referred as a second electrode. In actual application, the first electrode may be a drain electrode and the second electrode may be a source electrode; or, the first electrode may be a source electrode and the second electrode may be a drain electrode.

A pixel circuit of one embodiment of the present disclosure includes a plurality of rows of gate lines, a plurality of rows of read-control lines, pixel unit circuits arranged in rows and columns and a driving module. The pixel unit circuit includes a pixel compensation unit. The driving module includes a gate drive circuit coupled with the rows of gate lines. The driving module further includes a signal generation unit. The signal generation unit is coupled with the gate drive circuit and the pixel compensation unit, and is configured to generate a read-control signal and a gate drive-control signal, transmit the read-control signal to the corresponding read-control line and transmit the gate drive-control signal to the gate drive circuit.

The gate drive circuit is configured to, based on the gate drive-control signal, generate a plurality of gate drive signals, thereby controlling the rows of gate lines to be turned off in the reading period.

The driving module in the pixel circuit of one embodiment of the present disclosure includes the signal generation unit, and the read-control signal and the gate drive-control signal generated by the signal generation unit can enable display driving and compensation for luminance brightness of pixel units to be performed at different times, thereby avoiding influence of timing of gate and data lines on a light sensing module.

Figure 7:
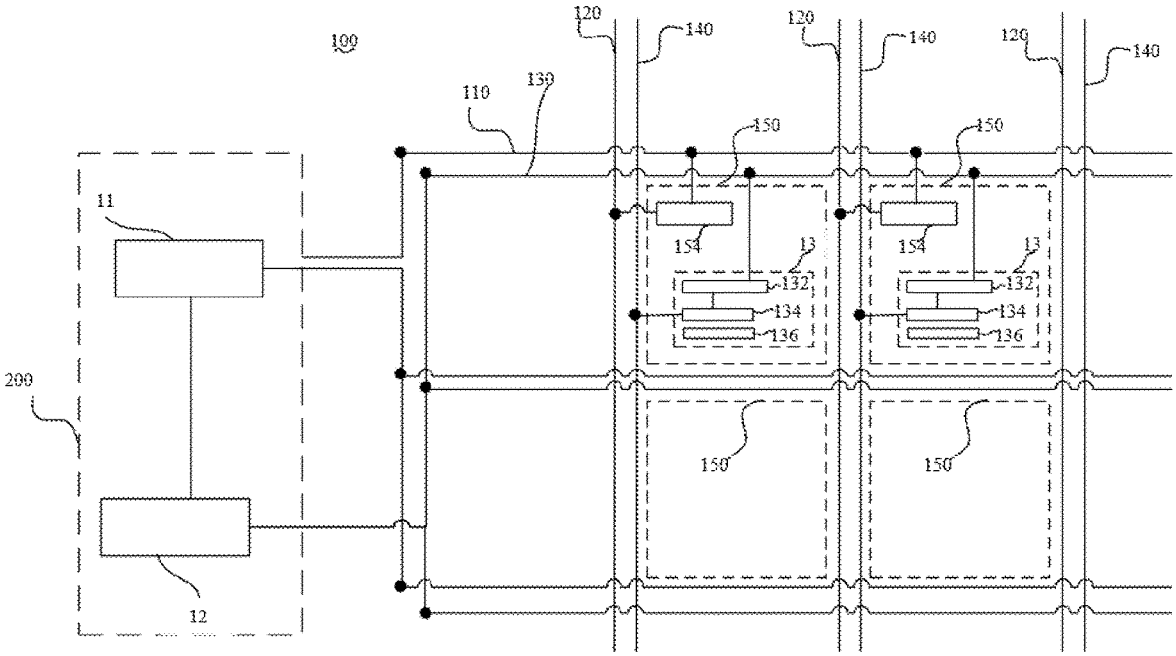
FIG. 7 is a schematic diagram of a pixel circuit according to an embodiment of the present disclosure.

In actual implementation, as shown in FIG. 7, a pixel circuit 100 may include a plurality of rows of gate lines 110, a plurality of columns of data lines 120, a plurality of rows of read-control lines 130, a plurality of columns of read lines 140, pixel unit circuits 150 arranged in rows and columns and a driving module 200. The pixel unit circuits 150 in an identical row is coupled with an identical row of gate line 110 and an identical row of read-control line 130. The pixel unit circuits in an identical column are coupled with an identical column of data line and an identical column of read line.

The pixel unit circuit 150 includes a pixel compensation unit 13 and a pixel unit 154.

The pixel compensation unit 13 includes: a light sensing module 132 configured to convert a light signal emitted by the pixel unit 154 into a corresponding electrical signal; a read-control module 134 configured to control transmission of the electrical signal to the corresponding column of reading line 140 during a reading period under control of a read control signal on the corresponding row of read-control line 130; and a data voltage compensation module 136.

Figure 1B:
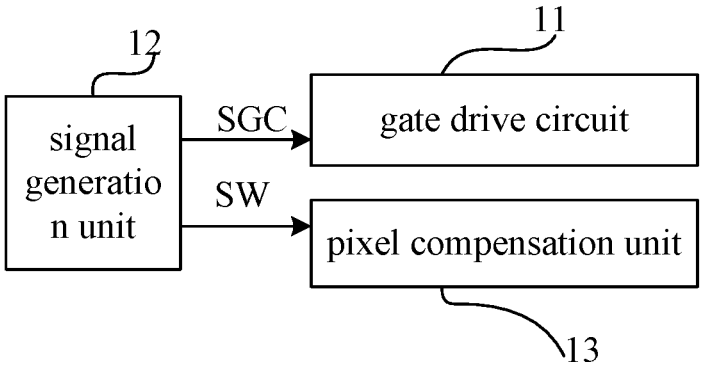
FIG. 1B is a schematic diagram of a driving module of a pixel circuit according to an embodiment of the present disclosure.

As shown in FIG. 1B, the driving module 200 in the pixel circuit of one embodiment of the present disclosure includes a gate drive circuit 110 coupled with the rows of gate lines 110. The driving module further includes a signal generation unit 12. The signal generation unit 12 is coupled with the gate drive circuit 11 and the pixel compensation unit 13. The signal generation unit 12 is configured to generate a read-control signal SW and a gate drive-control signal SGC, transmit the read-control signal SW to the pixel compensation unit 13 through the row of read-control line 130 corresponding to the pixel compensation unit 13, and transmit the gate drive-control signal SGC to the gate drive circuit 11.

The gate drive circuit 11 is configured to, based on the gate drive-control signal, generate a plurality of gate drive signals, thereby controlling the rows of gate lines to be turned off in the reading period. One gate drive-control signal corresponds to one row of gate line.

The driving module in the pixel circuit of one embodiment of the present disclosure includes the signal generation unit 12, and the read-control signal and the gate drive-control signal generated by the signal generation unit 12 can enable display driving and compensation for luminance brightness of pixel units to be performed at different times, thereby avoiding influence of timing of gate and data lines on the light sensing module.

In actual implementation, the signal generation unit 12 is specifically configured to generate the read-control signal based on the electrical signal.

In actual implementation, the electrical signal may be a charge signal, and the signal generation unit is specifically configured to determine a corresponding integration time based on quantity of electric charges indicated by the electrical signal and generate a corresponding read-control signal based on the integration time.

The integration time is a time interval between a first moment and a second moment. The first moment is a moment at which the read-control module 134 is controlled by the read control signal to begin transmitting the electrical signal to the corresponding column of read line 140. The second moment is a moment at which the read-control module 134 is controlled by the read control signal for the next time to begin transmitting the electrical signal to the corresponding column of read line 140 after the reading period ends.

The driving module in the pixel circuit of one embodiment of the present disclosure can determine the integration time based on the quantity of electric charges. When the quantity of electric charges is large, the integration time is short; when the quantity of electric charges is small, the integration time is long. In this way, the integration time can be dynamically adjusted according to the quantity of electric charges, to adapt to a large dynamic range of light intensity detection.

In actual implementation, the light sensing module 132 senses a light signal emitted by the corresponding pixel unit 154, and converts the light signal into an electrical signal. The quantity of electric charges indicated by the electrical signal may be the quantity of electric charges stored in parasitic capacitance (for example, when the pixel compensation unit 13 adopts the structure shown in FIG. 1A, the light sensing module 132 may be a photodiode DS, the read-control module 134 may be a read-control transistor MS; then the parasitic capacitance may be parasitic capacitance between a cathode of the photodiode DS and an anode of the photodiode DS). When the read-control signal on the read-control line 130 controls the read-control module i.e., the read-control transistor MS to turn on connection between the light sensing module 132 i.e., the photodiode DS, and the read line, the electric charges stored in the parasitic capacitance are transmitted to the read line.

Figure 2:
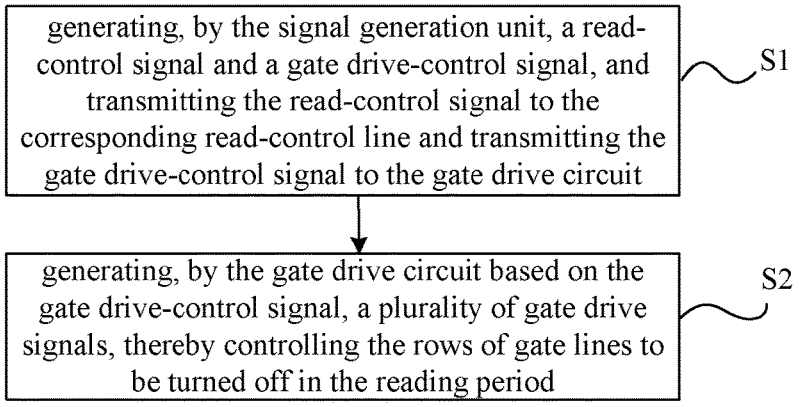
FIG. 2 is a flow chart of a method for driving a pixel circuit according to an embodiment of the present disclosure.

A pixel circuit driving method according to an embodiment of the present disclosure adopts the above driving module to drive the pixel circuit. As shown in FIG. 2, the pixel circuit driving method includes:

S1: generating, by the signal generation unit, a read-control signal and a gate drive-control signal, and transmitting the read-control signal to the corresponding read-control line and transmitting the gate drive-control signal to the gate drive circuit; and S2: generating, by the gate drive circuit based on the gate drive-control signal, a plurality of gate drive signals, thereby controlling the rows of gate lines to be turned off in the reading period.

In the pixel circuit driving method of one embodiment of the present disclosure, the signal generation unit generates the read-control signal and the gate drive-control signal, which can enable display driving and compensation for luminance brightness of pixel units to be performed at different times, thereby avoiding influence of timing of gate and data lines on a light sensing module.

In actual implementation, the pixel circuit includes a plurality of rows of gate lines, a plurality of columns of data lines, a plurality of rows of read-control lines, a plurality of columns of read lines, pixel unit circuits arranged in rows and columns. The pixel unit circuits in an identical row are coupled with an identical row of gate line and an identical row of read-control line. The pixel unit circuits in an identical column are coupled with an identical column of data line and an identical column of read line.

The pixel unit circuit includes a pixel compensation unit and a pixel unit.

The pixel compensation unit includes: a light sensing module configured to convert a light signal emitted by the pixel unit into a corresponding electrical signal; a read-control module coupled with the corresponding row of read-control line and the corresponding column of read line, and configured to control transmission of the electrical signal to the corresponding column of reading line during a reading period under control of a read control signal on the corresponding row of read-control line; and a data voltage compensation module.

Specifically, the step that the signal generation unit generates the read-control signal includes: generating, by the signal generation unit based on the electrical signal, the read-control signal.

In actual implementation, the electrical signal may be a charge signal, and the step that the signal generation unit generates the read-control signal based on the electrical signal, may specifically include: determining, by the signal generation unit, a corresponding integration time based on quantity of electric charges indicated by the electrical signal and generating a corresponding read-control signal based on the integration time.

The integration time is a time interval between a first moment and a second moment. The first moment is a moment at which the read-control module is controlled by the read control signal to begin transmitting the electrical signal to the corresponding column of read line. The second moment is a moment at which the read-control module is controlled by the read control signal for the next time to begin transmitting the electrical signal to the corresponding column of read line after the reading period ends.

Optionally, a first quantity of electric charges indicated by a first charge signal is greater than a second quantity of electric charges indicated by a second charge signal; then, a first integration time determined by the signal generation unit based on the first quantity of electric charges, is less than a second integration time determined by the signal generation unit based on the second quantity of electric charges.

In the pixel circuit driving method of one embodiment of the present disclosure, the integration time is determined based on the quantity of electric charges. When the quantity of electric charges is large, the integration time is short; when the quantity of electric charges is small, the integration time is long. In this way, the integration time can be dynamically adjusted according to the quantity of electric charges, to adapt to a large dynamic range of light intensity detection.

In a first embodiment of the pixel circuit driving method of the present disclosure, in one driving cycle, an n-th reading period is set between a period in which an n-th row of gate line is turned on and a period in which an (n+1)-th row of gate line is turned on; an N-th reading period is set in adjacent two driving cycles. N represents the quantity of rows of gate lines included in the pixel circuit, and N is a positive integer.

The step that the signal generation unit transmits the read-control signal to the corresponding read-control line, specifically includes:

outputting, by the signal generation unit, a corresponding read-control signal to an n-th row of read-control line, thereby enabling the read-control modules of all the pixel compensation units in the n-th row of the pixel circuit to be turned on in the n-th reading period and then turning on connection between the light sensing modules of the pixel compensation units in the n-th row and the corresponding columns of read lines; and outputting, by the signal generation unit, a corresponding read-control signal to an N-th row of read-control line, thereby enabling the read-control modules of all the pixel compensation units in the N-th row of the pixel circuit to be turned on in the N-th reading period and then turning on connection between the light sensing modules of the pixel compensation units in the N-th row and the corresponding columns of read lines.

The step that the gate drive circuit generates a plurality of gate drive signals based on the gate drive-control signal, thereby controlling the rows of gate lines to be turned off in the reading period, specifically includes: generating, by the gate drive circuit based on the gate drive-control signal, a plurality of gate drive signals, thereby controlling all the rows of gate lines in the pixel circuit to be turned off in the n-th reading period and the N-th reading period, where n is a positive integer and (n+1) is less than or equal to N.

Figure 3:
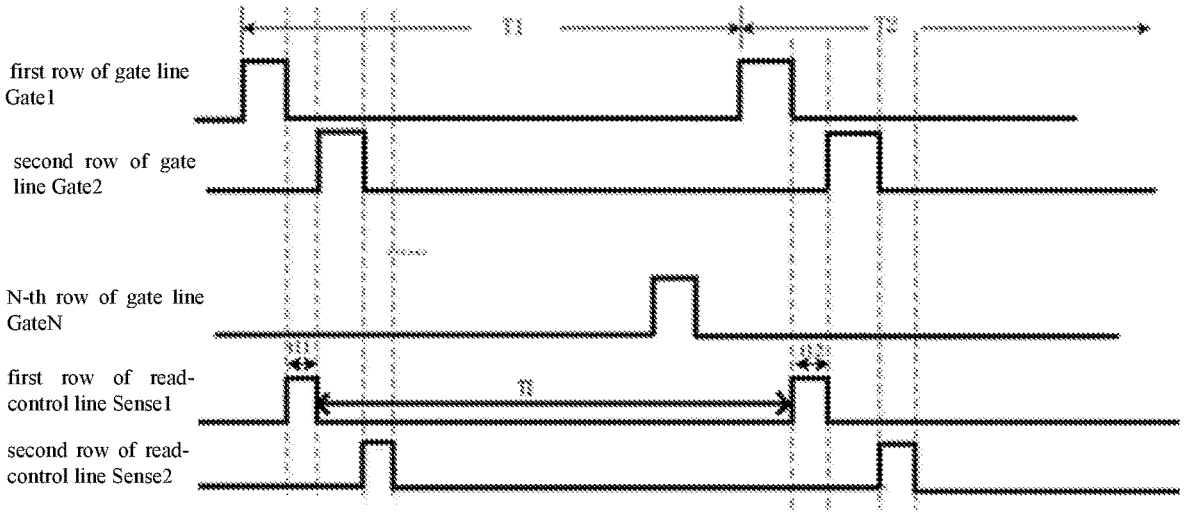
FIG. 3 is a timing diagram corresponding to a first embodiment of a method for driving a pixel circuit according to the present disclosure.

The first embodiment of the pixel circuit driving method of the present disclosure is a single-line idle detection mode. As shown in FIG. 3, in a first driving cycle T1 (when the gate drive circuit includes N-level shift register units for driving N rows of gate lines, one driving cycle is a time period for scanning the N rows of gate lines, N is an integer greater than 3), a first reading period t11 (i.e., a period in which a first row of read-control line Sense1 outputs a high level signal) in the first driving cycle T1 is set between a period in which a first row of gate line Gate1 is turned on (i.e., a period in which a potential of the gate drive signal for driving the gate line Gate1 is high level) and a period in which a second row of gate line Gate2 is turned on (i.e., a period in which a potential of the gate drive signal for driving the gate line Gate2 is high level);

a second reading period in the first driving cycle T1 (i.e., a period in which a second row of read-control line Sense2 outputs a high level signal) is set between the period in which the second row of gate line Gate2 is turned on (i.e., the period in which the potential of the gate drive signal for driving the gate line Gate2 is high level) and a period in which a third row of gate line Gate3 is turned on (i.e., a period in which a potential of the gate drive signal for driving the gate line Gate3 is high level);

In FIG. 3, the reference number GateN represents the N-th row of gate line, and a waveform corresponding to GateN is a waveform of the gate drive signal for driving GateN.

In a second driving cycle T2, a first reading period t21 (i.e., a period in which the first row of read-control line Sense1 outputs a high level signal) in the second driving cycle T2 is set between a period in which the first row of gate line Gate1 is turned on (i.e., a period in which a potential of the gate drive signal for driving the gate line Gate1 is high level) and a period in which the second row of gate line Gate2 is turned on (i.e., a period in which a potential of the gate drive signal for driving the gate line Gate2 is high level).

A second reading period in the second driving cycle T2 (i.e., a period in which the second row of read-control line Sense2 outputs a high level signal) is set between the period in which the second row of gate line Gate2 is turned on (i.e., the period in which the potential of the gate drive signal for driving the gate line Gate2 is high level) and a period in which the third row of gate line Gate3 is turned on (i.e., a period in which a potential of the gate drive signal for driving the gate line Gate3 is high level).

In the first embodiment of the pixel circuit driving method shown in FIG. 3 of the present disclosure, the integration time TI is a time interval between a moment when t11 ends and a moment when t21 starts, i.e., equal to one frame time (which is duration of one driving cycle).

In the first embodiment of the pixel circuit driving method shown in FIG. 3 of the present disclosure, charge reading is performed in a time gap between scanning times of every two rows of gate lines. In order to adapt to a large dynamic range of detection (when an OLED emits light, a gray scale voltage is between 0 and 255, which may vary greatly), it is needed to dynamically adjust an exposure time based on the read value. When an amount of charges read is too small, it is needed to increase the integration time; when amount of charges read is too large, even saturated, then it is needed to reduce the integration time.

In a second embodiment of the pixel circuit driving method of the present disclosure, in one driving cycle, an n-th reading period is set between a period in which an n-th row of gate line is turned on and a period in which an (n+1)-th row of gate line is turned on; an (n+1)-reading period is set between the period in which the (n+1)-th row of gate line is turned on and a period in which an (n+2)-th row of gate line is turned on; an N-reading period is set in adjacent two driving cycles. N represents the quantity of rows of gate lines included in the pixel circuit, and N is a positive integer.

The step that the signal generation unit transmits the read-control signal to the corresponding read-control line, specifically includes:

outputting, by the signal generation unit, a corresponding read-control signal to an n-th row of read-control line, thereby enabling the read-control modules of all the pixel compensation units in the n-th row of the pixel circuit to be turned on in the n-th reading period and the (n+1)-th reading period, and then turning on connection between the light sensing modules of the pixel compensation units in the n-th row and the corresponding columns of read lines; and outputting, by the signal generation unit, a corresponding read-control signal to an N-th row of read-control line, thereby enabling the read-control modules of all the pixel compensation units in the N-th row of the pixel circuit to be turned on in the N-th reading period and the first reading period and then turning on connection between the light sensing modules of the pixel compensation units in the N-th row and the corresponding columns of read lines.

The step that the gate drive circuit generates a plurality of gate drive signals based on the gate drive-control signal, thereby controlling the rows of gate lines to be turned off in the reading period, specifically includes: generating, by the gate drive circuit based on the gate drive-control signal, a plurality of gate drive signals, thereby controlling all the rows of gate lines in the pixel circuit to be turned off in the n-th reading period and the N-th reading period, where n is a positive integer and (n+1) is less than or equal to N.

Figure 4:
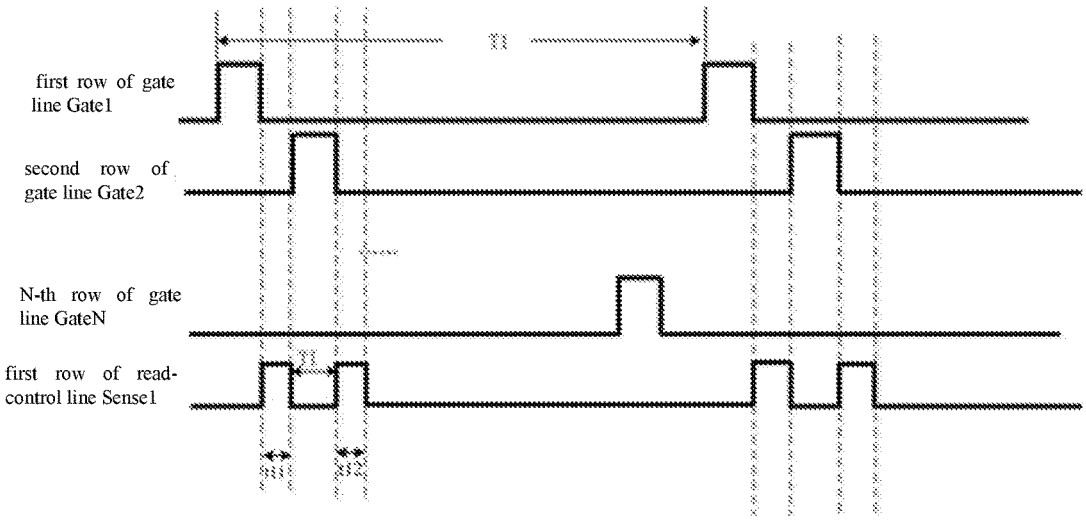
FIG. 4 is a timing diagram corresponding to a second embodiment of a method for driving a pixel circuit according to the present disclosure.

The second embodiment of the pixel circuit driving method of the present disclosure is another single-line idle detection mode. As shown in FIG. 4, in a first driving cycle T1 (when the gate drive circuit includes N-level shift register units for driving N rows of gate lines, one driving cycle is a time period for scanning the N rows of gate lines, N is an integer greater than 3), a first reading period t11 in the first driving cycle T1 is set between a period in which a first row of gate line Gate1 is turned on and a period in which a second row of gate line Gate2 is turned on; a second reading period t12 in the first driving cycle T1 is set between the period in which the second row of gate line Gate2 is turned on and a period in which a third row of gate line Gate3 is turned on;

in the first reading period t11 and the second reading period t12, the first row of read-control line Sense1 outputs a high level signal.

In the second embodiment of the pixel circuit driving method shown in FIG. 4 of the present disclosure, the integration time TI is a time interval between a moment when t11 ends and a moment when t21 starts, i.e., duration of one row.

In a third first embodiment of the pixel circuit driving method of the present disclosure, a blank stage is set between two adjacent display stages. The blank stage includes M reading periods arranged sequentially, where M is a quantity of rows of read-control lines included in the pixel circuit, and M is a positive integer.

The step that the gate drive circuit generates a plurality of gate drive signals based on the gate drive-control signal, thereby controlling the rows of gate lines to be turned off in the reading period, specifically includes: generating, by the gate drive circuit based on the gate drive-control signal, a plurality of gate drive signals, thereby controlling all the gate lines in the pixel circuit to be turned off in the blank stage.

The step that the signal generation unit transmits the read-control signal to the corresponding read-control line specially includes:

outputting, by the signal generation unit, a corresponding read-control signal to an a-th row of read-control line, thereby enabling the read-control modules of all the pixel compensation units in the a-th row of the pixel circuit to be turned on in the a-th reading period of the blank stage and then turning on connection between the light sensing modules of the pixel compensation units in the a-th row and the corresponding columns of read lines; where a is a positive integer which is less than or equal to M.

In actual application, in one display stage, the gate drive circuit sequentially scans several rows of gate lines.

Figure 5:
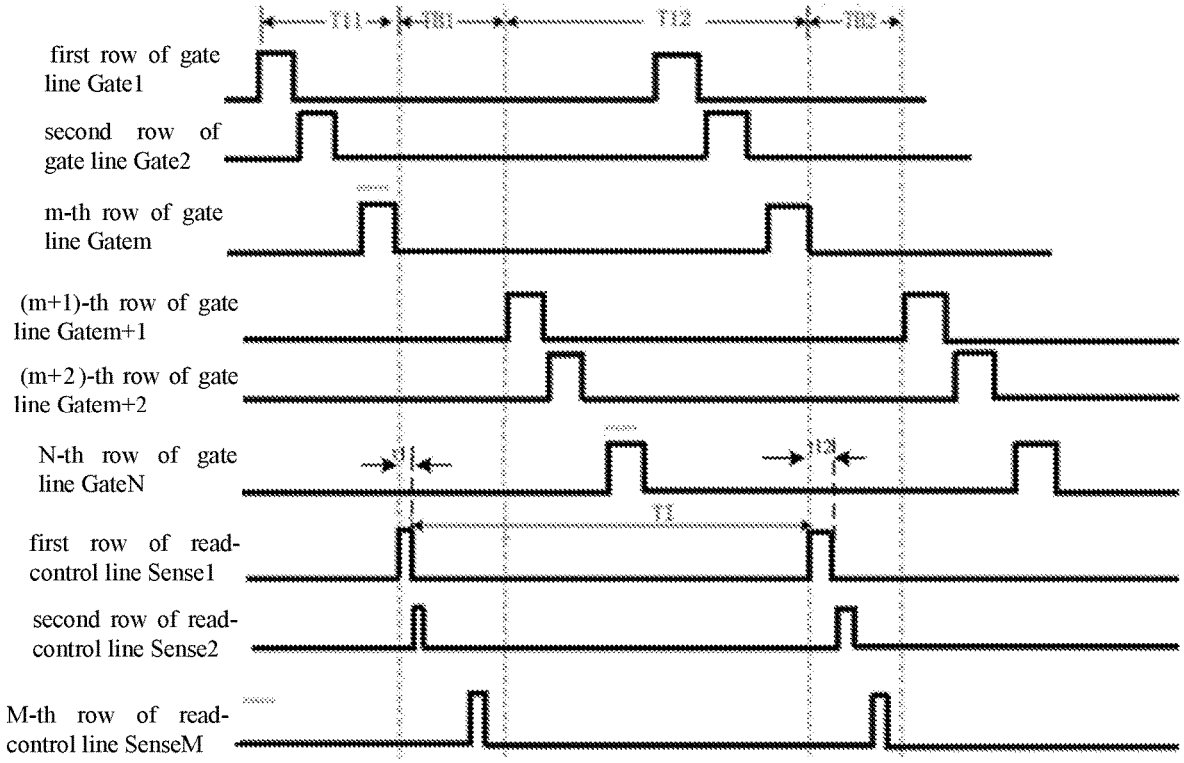
FIG. 5 is a timing diagram corresponding to a third embodiment of a method for driving a pixel circuit according to the present disclosure.

The third embodiment of the pixel circuit driving method of the present disclosure is a multi-line idle detection mode. As shown in FIG. 5, a blank stage is set between two adjacent display stages. The blank stage includes M reading periods arranged sequentially, where M is a quantity of rows of read-control lines included in the pixel circuit, FIG. 6 only shows two display stages and two blank stages included in one driving cycle which includes:

in a first display stage T11, sequentially driving a first row of gate line Gate1, a second row of gate line Gate2, . . . , an m-th row of gate line Gatem (where m is a positive integer);

in a first blank stage TB1, sequentially turning on M rows of read-control lines (i.e., the various rows of read-control lines sequentially output high-level signals, thereby sequentially controlling the read-control modules to turn on connection between the corresponding light sensing modules and the corresponding read lines); in FIG. 5, Sense1 represents a first row of read-control line, Sense2 represents a second row of read-control line, and SenseM represents an M-th row of read-control line;

in a second display stage T12, sequentially driving an (m+1)-th row of gate line Gatem+1, an (m+2)-th row of gate line Gatem+2, . . . , an N-th row of gate line GateN (where N represents the quantity of gate lines included in the pixel circuit), then sequentially driving the first row of gate line Gate1, the second row of gate line Gate2, . . . , the m-th row of gate line Gatem (where m is a positive integer greater than 2);

in a second blank stage, sequentially turning on M rows of read-control lines (i.e., the various rows of read-control lines sequentially output high-level signals, thereby sequentially controlling the read-control modules to turn on connection between the corresponding light sensing modules and the corresponding read lines).

In FIG. 5, a period in which Sense1 outputs a high-level signal for the first time, is the first display stage T11; a period in which Sense1 outputs the high-level signal for the second time, is the second display stage T12; the integration time TI is equal to a time interval between a moment when t11 ends and a moment when t21 starts.

The third embodiment of the pixel circuit driving method shown in FIG. 5 of the present disclosure is a long H blank mode, i.e., the reading period is inserted after completion of driving several rows of gate lines.

In a fourth embodiment of the pixel circuit driving method of the present disclosure, a blank cycle is set between two adjacent display cycles. The blank cycle includes M reading periods arranged sequentially, where M is a quantity of rows of read-control lines included in the pixel circuit, and M is a positive integer.

The step that the gate drive circuit generates a plurality of gate drive signals based on the gate drive-control signal, thereby controlling the rows of gate lines to be turned off in the reading period, specifically includes: generating, by the gate drive circuit based on the gate drive-control signal, a plurality of gate drive signals, thereby controlling all the gate lines in the pixel circuit to be turned off in the blank cycle.

The step that the signal generation unit transmits the read-control signal to the corresponding read-control line specially includes: outputting, by the signal generation unit, a corresponding read-control signal to a b-th row of read-control line, thereby enabling the read-control modules of all the pixel compensation units in the b-th row of the pixel circuit to be turned on in the b-th reading period of the blank cycle and then turning on connection between the light sensing modules of the pixel compensation units in the b-th row and the corresponding columns of read lines; where b is a positive integer which is less than or equal to M.

Figure 6:
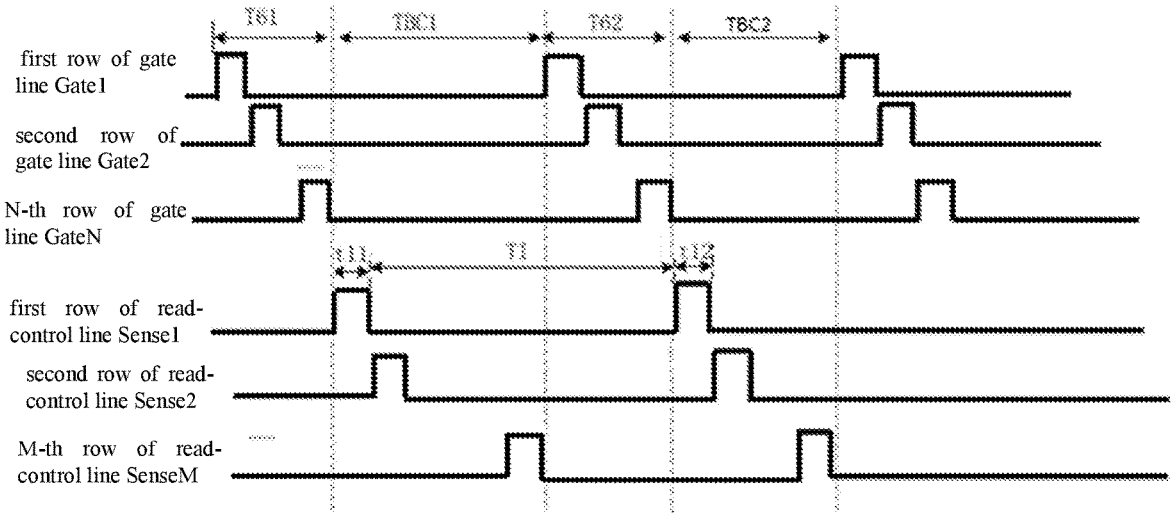
FIG. 6 is a timing diagram corresponding to a fourth embodiment of a method for driving a pixel circuit according to the present disclosure.

The fourth embodiment of the pixel circuit driving method of the present disclosure is a multi-frame idle detection mode. As shown in FIG. 6, a blank cycle is set between two adjacent display cycles.

The blank cycle includes M reading periods arranged sequentially, where M is a quantity of rows of read-control lines included in the pixel circuit, and M is a positive integer.

In the further embodiment of the present disclosure, in one display cycle, all gate lines of the pixel circuit are sequentially driven; in the blank cycle, all rows of read-control lines of the pixel circuit sequentially output high-level signals. One display cycle may be one frame time, and then one display cycle is set between two adjacent frames of display time.

As shown in FIG. 6, in a first display cycle T61, the first row of gate line Gate1, the second row of gate line Gate2, . . . , the N-th row of gate line GateN sequentially output a high-level signal; in a first blank cycle TBC1, a first row of read-control line Sense1, a second row of read-control line Sense2, . . . , an M-th row of read-control line SenseM sequentially output a high-level signal.

In a second display cycle T62, the first row of gate line Gate1, the second row of gate line Gate2, . . . , the N-th row of gate line GateN sequentially output a high-level signal; in a second blank cycle TBC2, the first row of read-control line Sense1, the second row of read-control line Sense2, . . . , the M-th row of read-control line SenseM sequentially output a high-level signal.

In the first blank cycle TBC1, a period in which Sense1 outputs the high-level signal is the first reading period t11; in the second blank cycle TBC2, a period in which Sense1 outputs the high-level signal is the second reading period t12. The integration time TI is a time interval between a moment when t11 ends and a moment when t21 starts.

In one embodiment of the present disclosure, a maximum integration time may be very long, reaching one frame or even several frames.

One embodiment of the present disclosure provides a display device which includes a pixel circuit and the above pixel circuit driving module.

The above are merely the optional embodiments of the present disclosure. It should be noted that, a person skilled in the art may make improvements and modifications without departing from the principle of the present disclosure, and these improvements and modifications shall also fall within the scope of the present disclosure.

What is claimed is:

1. A pixel circuit comprising:

a plurality of rows of gate lines;

a plurality of rows of read-control lines;

a plurality of pixel unit circuits arranged in rows and columns; and a driving module;

wherein each of the plurality of pixel unit circuits includes a pixel unit and a pixel compensation unit, and each pixel compensation unit is coupled with a corresponding row of read-control line; the driving module includes a gate drive circuit coupled with the rows of gate lines, and a signal generation unit;

the signal generation unit is coupled with the gate drive circuit and the pixel compensation units, and is configured to generate a read-control signal and a gate drive-control signal, transmit the read-control signal to a corresponding row of read-control line and transmit the gate drive-control signal to the gate drive circuit;

the gate drive circuit is configured to, based on the gate drive-control signal, generate a plurality of gate drive signals to control the rows of gate lines to be turned off in a reading period;

wherein, for one of the plurality of pixel unit circuits, the pixel compensation unit includes a light sensing module configured to convert a light signal emitted by the pixel unit into a corresponding electrical signal; and the signal generation unit is configured to generate the read-control signal based on the electrical signal.

2. The pixel circuit of claim 1, wherein the pixel compensation unit for the one of the plurality of pixel unit circuits includes a read-control module; the pixel circuit further includes a plurality of columns of read lines; the read-control module is coupled with a corresponding column of read line; the electrical signal is a charge signal;

the signal generation unit is configured to determine a corresponding integration time based on quantity of electric charges indicated by the electrical signal and generate the read-control signal based on the integration time;

the integration time is a time interval between a first moment and a second moment, the first moment is a moment at which the read-control module is controlled by the read control signal to begin transmitting the electrical signal to the corresponding column of read line, and the second moment is a moment at which the read-control module is controlled by the read control signal for the next time to begin transmitting the electrical signal to the corresponding column of read line after the reading period ends.

3. A display device comprising the pixel circuit of claim 1.

4. A method for driving the pixel circuit of claim 1, comprising:

generating, by the signal generation unit, a read-control signal and a gate drive-control signal, and transmitting the read-control signal to the corresponding row of read-control line and transmitting the gate drive-control signal to the gate drive circuit; and generating, by the gate drive circuit based on the gate drive-control signal, a plurality of gate drive signals, to control the rows of gate lines to be turned off in a reading period.

5. The method of claim 4, wherein the pixel compensation unit for the one of the plurality of pixel unit circuits includes a light sensing module and a read-control module; the pixel circuit further includes a plurality of columns of read lines; the read-control module is coupled with a corresponding column of read line;

in one driving cycle, an n-th reading period is set between a period in which an n-th row of gate line is turned on and a period in which an (n+1)-th row of gate line is turned on; an N-th reading period is set in adjacent two driving cycles, where N is a quantity of rows of gate lines included in the pixel circuit, and N is a positive integer;

wherein transmitting, by the signal generation unit, the read-control signal to the corresponding row of read-control line includes:

outputting, by the signal generation unit, a corresponding read-control signal to an n-th row of read-control line, to enable the read-control modules of all the pixel compensation units in the n-th row of the pixel circuit to be turned on in the n-th reading period and then turning on connection between the light sensing modules of the pixel compensation units in the n-th row and the corresponding columns of read lines; and outputting, by the signal generation unit, a corresponding read-control signal to an N-th row of read-control line, to enable the read-control modules of all the pixel compensation units in the N-th row of the pixel circuit to be turned on in the N-th reading period and then turning on connection between the light sensing modules of the pixel compensation units in the N-th row and the corresponding columns of read lines;

wherein generating, by the gate drive circuit based on the gate drive-control signal, a plurality of gate drive signals, to control the rows of gate lines to be turned off in a reading period, includes:

generating, by the gate drive circuit based on the gate drive-control signal, a plurality of gate drive signals, to control all the gate lines in the pixel circuit to be turned off in the n-th reading period and the N-th reading period, where n is a positive integer and (n+1) is less than or equal to N.

6. The method of claim 4, wherein the pixel compensation unit for the one of the plurality of pixel unit circuits includes a light sensing module and a read-control module; the pixel circuit further includes a plurality of columns of read lines; the read-control module is coupled with the corresponding column of read line;

in one driving cycle, an n-th reading period is set between a period in which an n-th row of gate line is turned on and a period in which an (n+1)-th row of gate line is turned on; an (n+1)-reading period is set between the period in which the (n+1)-th row of gate line is turned on and a period in which an (n+2)-th row of gate line is turned on; an N-reading period is set in adjacent two driving cycles, where N is a quantity of rows of gate lines included in the pixel circuit, and N is a positive integer;

wherein transmitting, by the signal generation unit, the read-control signal to the corresponding row of read-control line includes:

outputting, by the signal generation unit, a corresponding read-control signal to an n-th row of read-control line, to enable the read-control modules of all the pixel compensation units in the n-th row of the pixel circuit to be turned on in the n-th reading period and the (n+1)-th reading period, and then turning on connection between the light sensing modules of the pixel compensation units in the n-th row and the corresponding columns of read lines; and outputting, by the signal generation unit, a corresponding read-control signal to an N-th row of read-control line, to enable the read-control modules of all the pixel compensation units in the N-th row of the pixel circuit to be turned on in the N-th reading period and the first reading period and then turning on connection between the light sensing modules of the pixel compensation units in the N-th row and the corresponding columns of read lines;

wherein generating, by the gate drive circuit based on the gate drive-control signal, a plurality of gate drive signals, to control the rows of gate lines to be turned off in a reading period, includes:

generating, by the gate drive circuit based on the gate drive-control signal, a plurality of gate drive signals, to control all the gate lines in the pixel circuit to be turned off in the n-th reading period and the N-th reading period, where n is a positive integer and (n+1) is less than or equal to N.

7. The method of claim 4, wherein the pixel compensation unit for the one of the plurality of pixel unit circuits includes a light sensing module and a read-control module; the pixel circuit further includes a plurality of columns of read lines; the read-control module is coupled with the corresponding column of read line; a blank stage is set between two adjacent display stages; the blank stage includes M reading periods arranged sequentially, where M is a quantity of rows of read-control lines included in the pixel circuit, and M is a positive integer;

wherein generating, by the gate drive circuit based on the gate drive-control signal, a plurality of gate drive signals, to control the rows of gate lines to be turned off in a reading period, includes: generating, by the gate drive circuit based on the gate drive-control signal, a plurality of gate drive signals, to control all the gate lines in the pixel circuit to be turned off in the blank stage;

wherein transmitting, by the signal generation unit, the read-control signal to the corresponding row of read-control line includes:

outputting, by the signal generation unit, a corresponding read-control signal to an a-th row of read-control line, to enable the read-control modules of all the pixel compensation units in the a-th row of the pixel circuit to be turned on in the a-th reading period of the blank stage and then turning on connection between the light sensing modules of the pixel compensation units in the a-th row and the corresponding columns of read lines; where a is a positive integer which is less than or equal to M.

8. The method of claim 4, wherein the pixel compensation unit for the one of the plurality of pixel unit circuits includes a light sensing module and a read-control module; the pixel circuit further includes a plurality of columns of read lines; the read-control module is coupled with the corresponding column of read line; a blank cycle is set between two adjacent display cycles;

wherein the blank cycle includes M reading periods arranged sequentially, M is a quantity of rows of read-control lines included in the pixel circuit, and M is a positive integer;

wherein generating, by the gate drive circuit based on the gate drive-control signal, a plurality of gate drive signals, to control the rows of gate lines to be turned off in a reading period, includes: generating, by the gate drive circuit based on the gate drive-control signal, a plurality of gate drive signals, to control all the gate lines in the pixel circuit to be turned off in the blank cycle;

wherein transmitting, by the signal generation unit, the read-control signal to the corresponding row of read-control line includes:

outputting, by the signal generation unit, a corresponding read-control signal to a b-th row of read-control line, to enable the read-control modules of all the pixel compensation units in the b-th row of the pixel circuit to be turned on in the b-th reading period of the blank cycle and then turning on connection between the light sensing modules of the pixel compensation units in the b-th row and the corresponding columns of read lines; where b is a positive integer which is less than or equal to M.

9. The method of claim 4, wherein generating, by the signal generation unit, a read-control signal includes: generating, by the signal generation unit based on an electrical signal, the read-control signal; wherein the electrical signal is obtained through converting, by a light sensing module of the pixel compensation unit, a light signal emitted from the pixel unit into an electrical signal.

10. The method of claim 9, wherein the pixel compensation unit for the one of the plurality of pixel unit circuits includes a read-control module; the pixel circuit further includes a plurality of columns of read lines; the read-control module is coupled with a corresponding column of read line; the electrical signal is a charge signal;

wherein generating, by the signal generation unit based on an electrical signal, the read-control signal, includes: determining, by the signal generation unit, a corresponding integration time based on quantity of electric charges indicated by the electrical signal and generating a corresponding read-control signal based on the integration time;

wherein the integration time is a time interval between a first moment and a second moment, the first moment is a moment at which the read-control module is controlled by the read control signal to begin transmitting the electrical signal to the corresponding column of read line, and the second moment is a moment at which the read-control module is controlled by the read control signal for the next time to begin transmitting the electrical signal to the corresponding column of read line after the reading period ends.

11. The method of claim 10, wherein the charge signal includes a first charge signal and a second charge signal, a first quantity of electric charges indicated by the first charge signal is greater than a second quantity of electric charges indicated by the second charge signal; a first integration time determined by the signal generation unit based on the first quantity of electric charges, is less than a second integration time determined by the signal generation unit based on the second quantity of electric charges.

* * * * *